United States Patent [19]

Holloway, Jr.

[11] 4,002,383

[45] Jan. 11, 1977

[54] MODULAR LABORATORY BENCH ASSEMBLY

[75] Inventor: Caswell Francis Holloway, Jr., Haverford, Pa.

[73] Assignee: The Holloway Corporation, Haverford, Pa.

[22] Filed: Sept. 11, 1975

[21] Appl. No.: 612,532

[52] U.S. Cl. ..... 312/209; 312/228; 312/257 SK

[51] Int. Cl.[2] ..... A47F 5/08; A47B 55/00

[58] Field of Search ..... 312/111, 194, 199, 209, 312/228, 257 R, 257 SK; 248/188.3; 211/176

[56] References Cited

UNITED STATES PATENTS

| | | | |
|---|---|---|---|
| 3,088,785 | 5/1963 | Schuette | 312/195 |
| 3,224,823 | 12/1965 | Schulze | 312/257 R |
| 3,231,903 | 2/1966 | Cope | 312/228 |
| 3,650,586 | 3/1972 | Nightingale | 312/195 |
| 3,857,622 | 12/1974 | Mohr | 312/195 |

*Primary Examiner*—Casmir A. Nunberg
*Attorney, Agent, or Firm*—William H. Murray

[57] ABSTRACT

A modular laboratory bench includes a counter top and a floor mounted frame for supporting the counter top at a predetermined height above the floor. The basic frame comprises two rigid preassembled side support members which are interlocked by a front angle bar, a rear angle bar and a rear spacer bar at a distance which defines a predetermined modular spacing therebetween. A modular cabinet unit can be rolled into the modular spacing between the side support members and secured therein by a faceplate attached to the front angle bar.

31 Claims, 13 Drawing Figures

Fig. 1
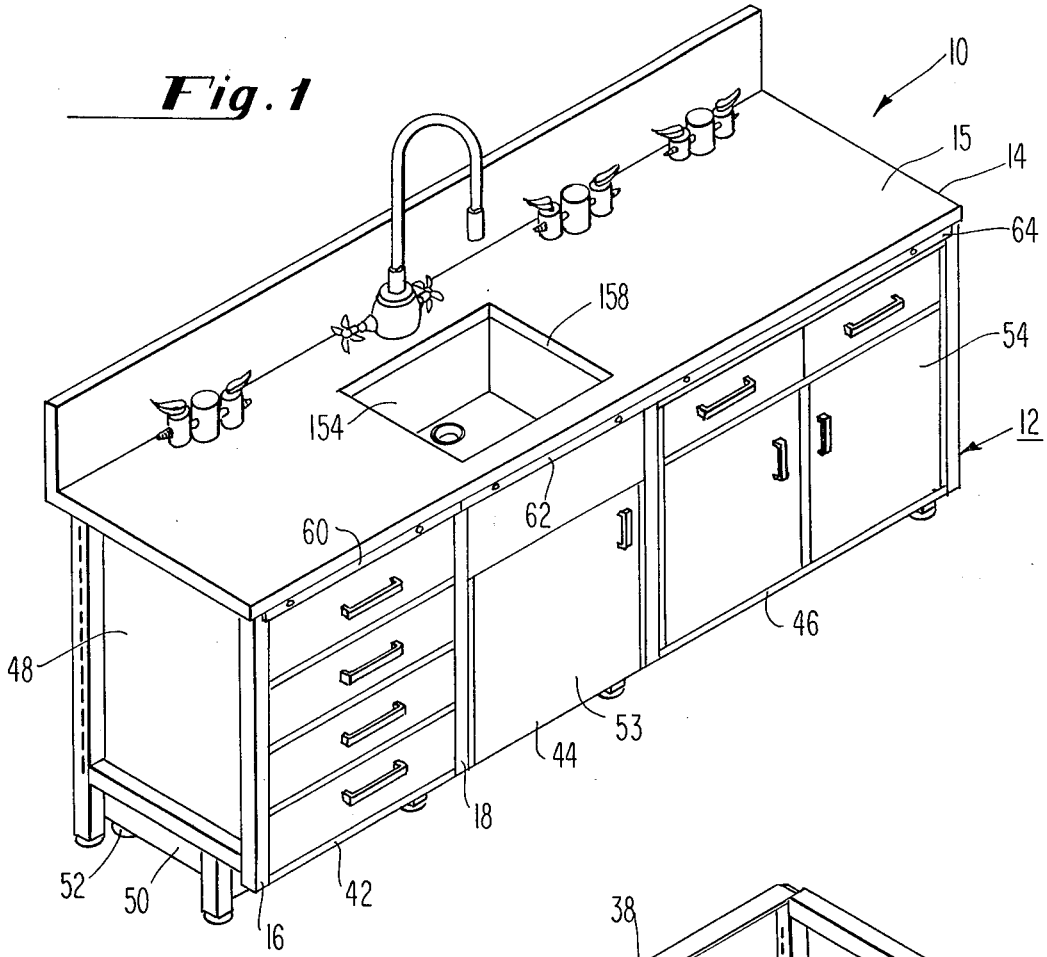
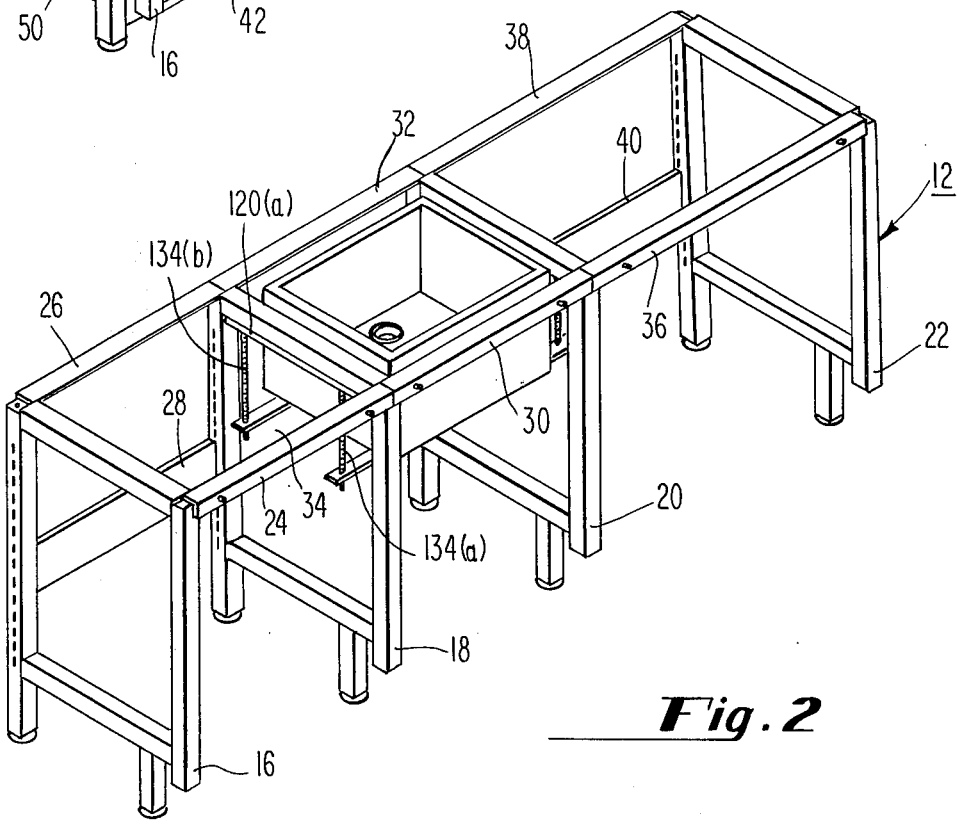
Fig. 2

Fig. 8
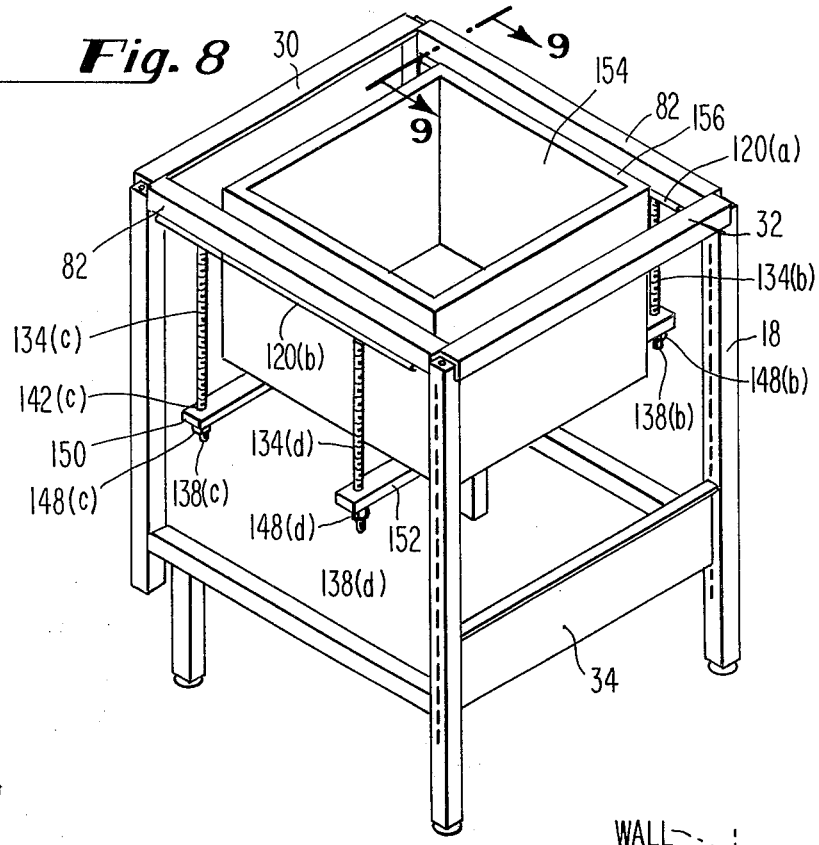
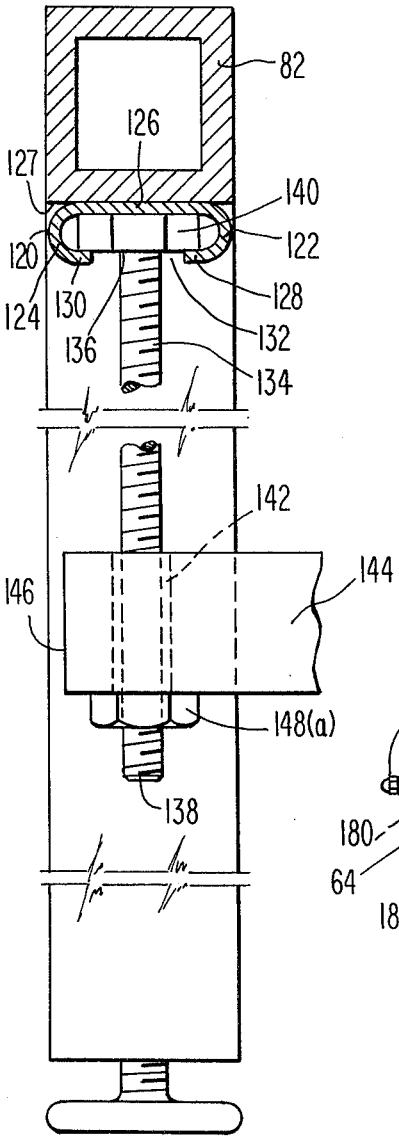
Fig. 9
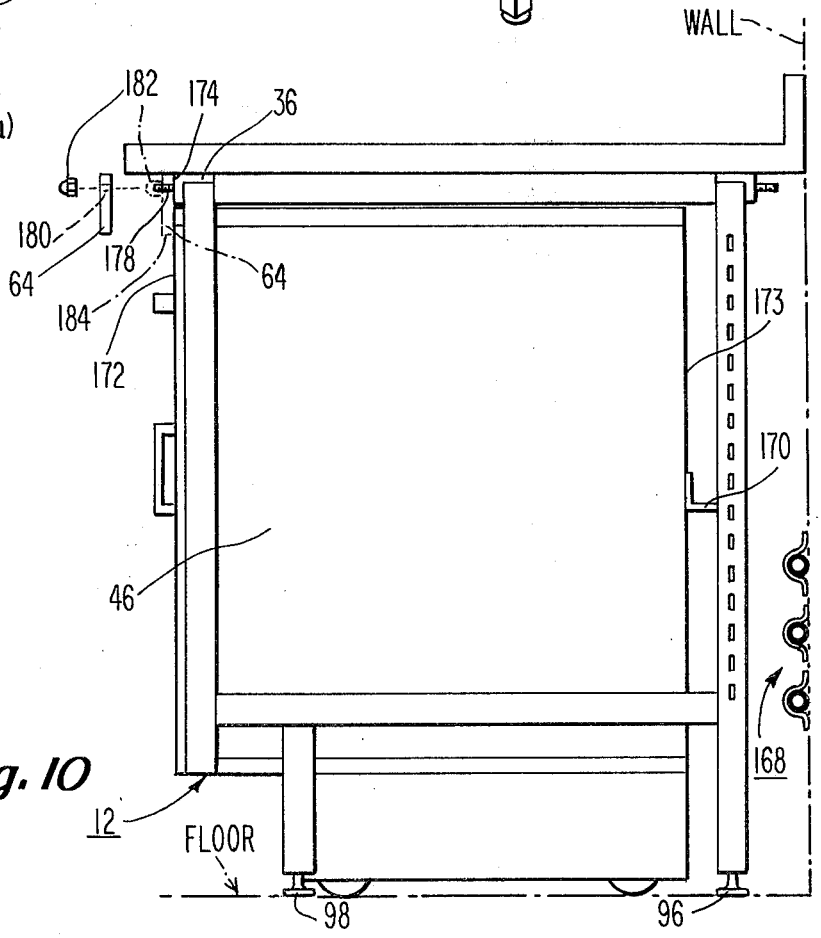
Fig. 10

MODULAR LABORATORY BENCH ASSEMBLY

BACKGROUND OF THE INVENTION

This invention relates to modular cabinet systems having a work surface thereon, and more particularly to laboratory-type bench assemblies of prefabricated, interchangeable, modular elements.

Benches having a frame structure, work surface and mass produced standard cupboard, cabinet or shelf units of a shape consistent with their function are well known in the art. The frame structure of these benches are often assembled and cabinet units are permanently attached thereto because the elements must be joined together in such a manner as to obtain the desired amount of stability and rigidity. The bench, oftentimes without the work surface attached, is then shipped as a unit to the purchaser. Even without the work surface attached, these benches are difficult to handle as they have great weight and bulk and often require two or more men just to move the benches around. In addition, great care must be exercised by the movers when bringing the benches into their use areas since the assembled benches and work surfaces are easily scratched. If the purchaser later decides that different shelf or cabinet units are desirable, he must purchase an entire bench with the desired units and have the other bench moved out or returned to the store to make room for the new bench.

An improvement over the above described benches is disclosed in U.S. Pat. No. 3,650,586 issued to Nightengale, et al. This improvement permits construction, at the use site, of a frame having a work surface thereon. Construction of the frame requires an assortment of nuts, bolts, washers and associated assembly tools. Subsequent to assembly of the frame and work surface, shelf units are attached to the assembled frame using a dolly. The shelf units are supported by the frame and are replaceable using the dolly to moveably support the shelf units outside of the frame. Note that because the frame supports the full weight of the installed shelf units as well as the contents thereof, the frame of the improved bench must be of a relatively heavy construction and joined together in such a manner as to obtain the amount of stability and rigidity required to support the installed shelf units as well as the work surface. A frame of this type can be relatively expensive to produce and assemble.

SUMMARY OF THE INVENTION

A modular laboratory bench assembly includes a counter top and a floor mounted frame for supporting the counter top at a predetermined height above the floor. The frame comprises at least two rigid, preassembled side support members having a plurality of receiving apertures therein as well as means for engaging the receiving apertures and interlocking adjacent side support members at a distance which defines a predetermined modular spacing therebetween.

BRIEF DESCRIPTION OF THE DRAWING

FIG. 1 is an isometric view of a modular laboratory bench assembly of the present invention.

FIG. 2 is an isometric view of a floor mounted frame having a sink installed therein.

FIG. 8 is an isometric view of that portion of the frame which defines a singular modular spacing showing a sink mounted within.

FIG. 9 is an enlarged, fragmentary sectional view taken along line 9—9 of FIG. 8.

FIG. 10 is an end elevational view of the modular laboratory bench assembly of the present invention.

DETAILED DESCRIPTION

Figure 3:
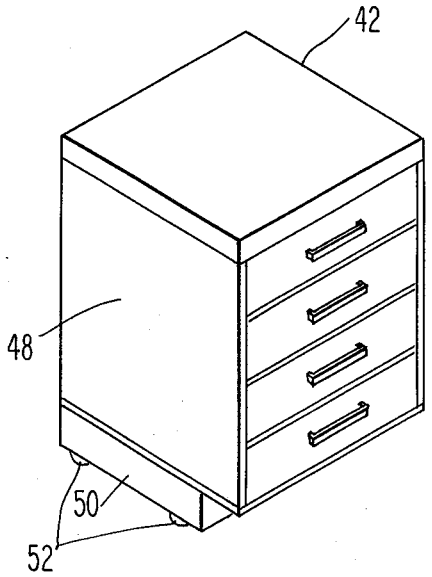
FIG. 3 is an isometric view of a modular cabinet unit having a singular modular width.

Referring to FIG. 1 there is shown a modular laboratory bench assembly of the present invention, generally referred to as 10. The modular laboratory bench assembly 10 comprises a floor mounted frame, generally referred to as 12, which supports a counter top 14, having an upper surface 15, preferably rectangular in shape, at a predetermined height above the floor. As shown in FIG. 2, the frame 12 comprises a first 16, second, 18, third 20 and fourth 22 side support members. These side support members are identical, with one exception which will be subsequently disclosed with respect to sink supports, and form one of the basic frame components. Adjacent side support members are connected by a pair of angle bars and one spacer bar at a distance which defines a predetermined modular spacing therebetween. The modular spacing can be any size up to and including 60 inches. For exemplary purposes, a single modular spacing will be defined as having a width of 24 inches and a double modular spacing will be defined as having a width of 48 inches, remembering however that the modular spacing can assume any width up to and including 60 inches. As shown in FIG. 2, the first side support member 16 is connected to the second side support member 18, defining a first single modular spacing therebetween, by a first angle bar 24, a second angle bar 26 and a first spacer bar 28. Similarly, the second side support member 18 is connected to the third side support member 20, defining a second single modular spacing therebetween, by a third angle bar 30, a fourth angle bar 32 and a second spacer bar 34. Likewise, the third side support member 20 is connected to the fourth side support member 22, defining a double modular spacing therebetween, by a fifth angle bar 36, a sixth angle bar 38 and a third spacer bar 40. The method of interconnection is hereinafter described in detail.

Figure 4:
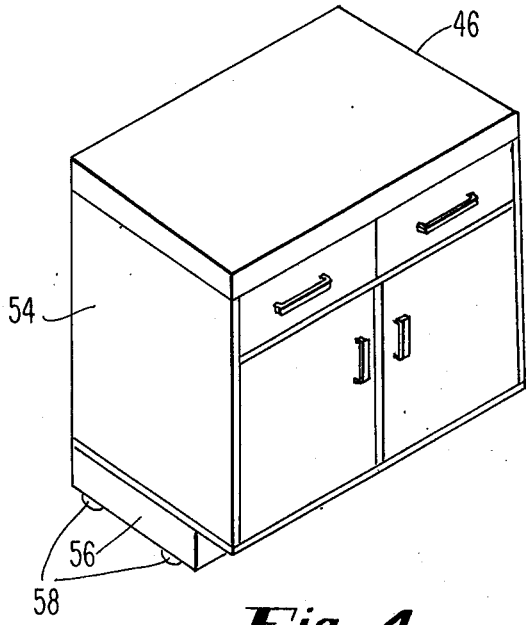
FIG. 4 is an isometric view of a modular cabinet unit having a double modular width.

Referring again to FIG. 1 there is shown a first 42, second 44 and third 46 modular cabinet units installed within the frame 12. The first modular cabinet unit 42 has a single modular width and is installed in the single modular spacing between the first 16 and second 18 side support members. The first modular cabinet unit 42 comprises a cabinet portion 48 mounted on a base 50 having casters 52 (see FIG. 3) for rollably supporting the cabinet unit on the floor. The second modular cabinet unit 44 has a singular modular width and is installed in the single modular spacing between the second 18 and third 20 side support members. The second modular cabinet unit 44 comprises a cabinet portion 53 mounted on a base having casters (not shown) for rollably supporting the cabinet unit on the floor. The third modular cabinet unit 46 has a double modular width and is installed in the double modular spacing between the third 20 and fourth 22 side support members. The third modular cabinet unit 46 comprises a cabinet portion 54 mounted on a base 56 having casters 58 (see FIG. 4) for rollably supporting the cabinet unit on the floor.

Figure 5:
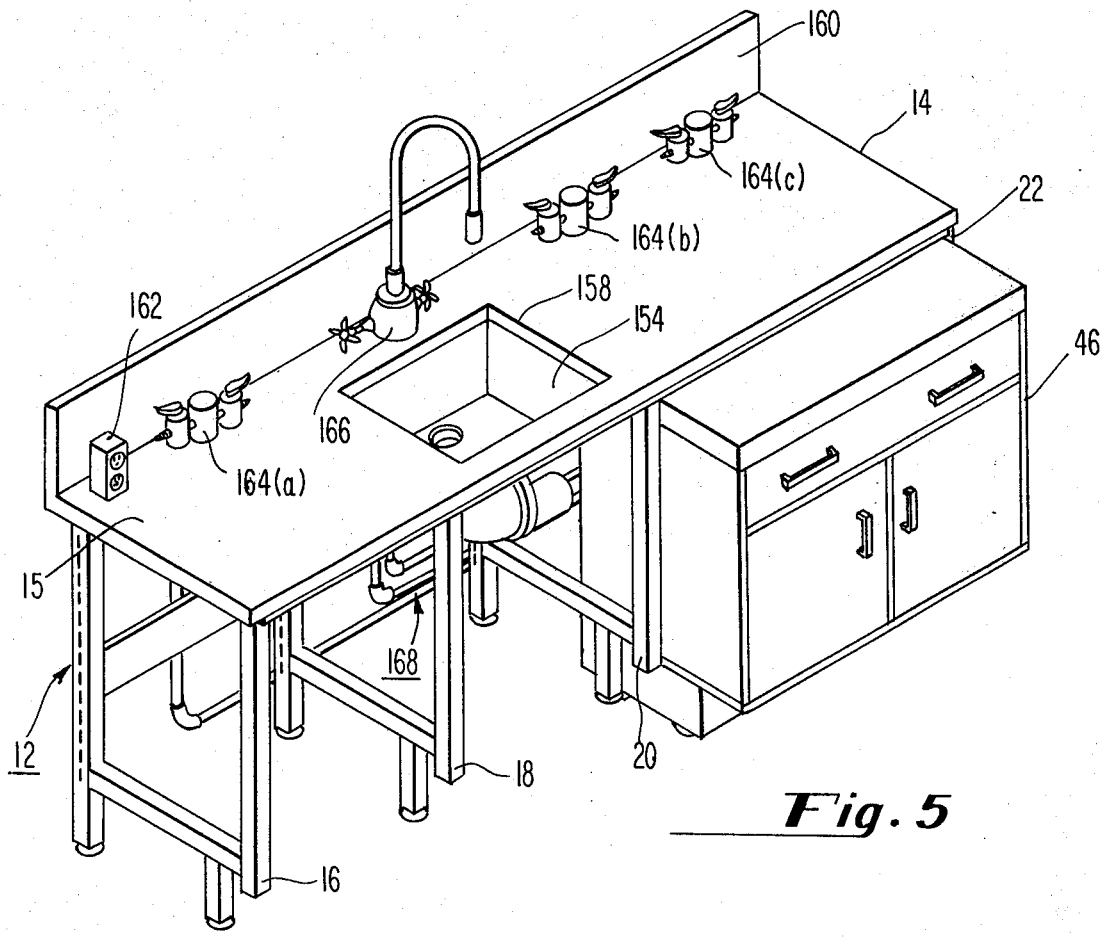
FIG. 5 is an isometric view of the double modular width cabinet unit being rolled beneath a counter top mounted on the floor mounted frame.

As shown in FIG. 5, the cabinet units are installed in the frame by simply rolling them into their respective modular spacings. FIG. 5 depicts the third modular cabinet unit 46 partially rolled into the double modular spacing between the third 20 and fourth 22 side support members. In a similar fashion, the first modular cabinet unit 42 would be rolled into the single modular spacing between the first 16 and second 18 side support members and the second modular cabinet unit 44 would be rolled into the single modular spacing between the second 18 and third 20 side support members. Each modular cabinet unit is held in place within the frame 12 by means of a faceplate attached to the front angle bar by any suitable attachment means. As shown in FIG. 1, the first modular cabinet unit 42 is held in place within the frame 12 by a first faceplate 60 attached to the first angle bar 24 (see FIG. 2). Similarly, the second modular cabinet unit 44 is held within the frame 12 by a second faceplate 62 attached to the third angle bar 30 (see FIG. 2) and the third modular cabinet unit 46 is held within the frame 12 by a third faceplate 64 attached to the fifth angle bar 36 (see FIG. 2). A preferred means of attachment will subsequently be described in detail.

Note that the floor supports the weight of the cabinet units both inside and outside of the frame 12. The frame merely receives the cabinet units and prevents, in conjunction with the attached faceplates, undesired movement of the installed cabinet units across the floor.

Figure 6:
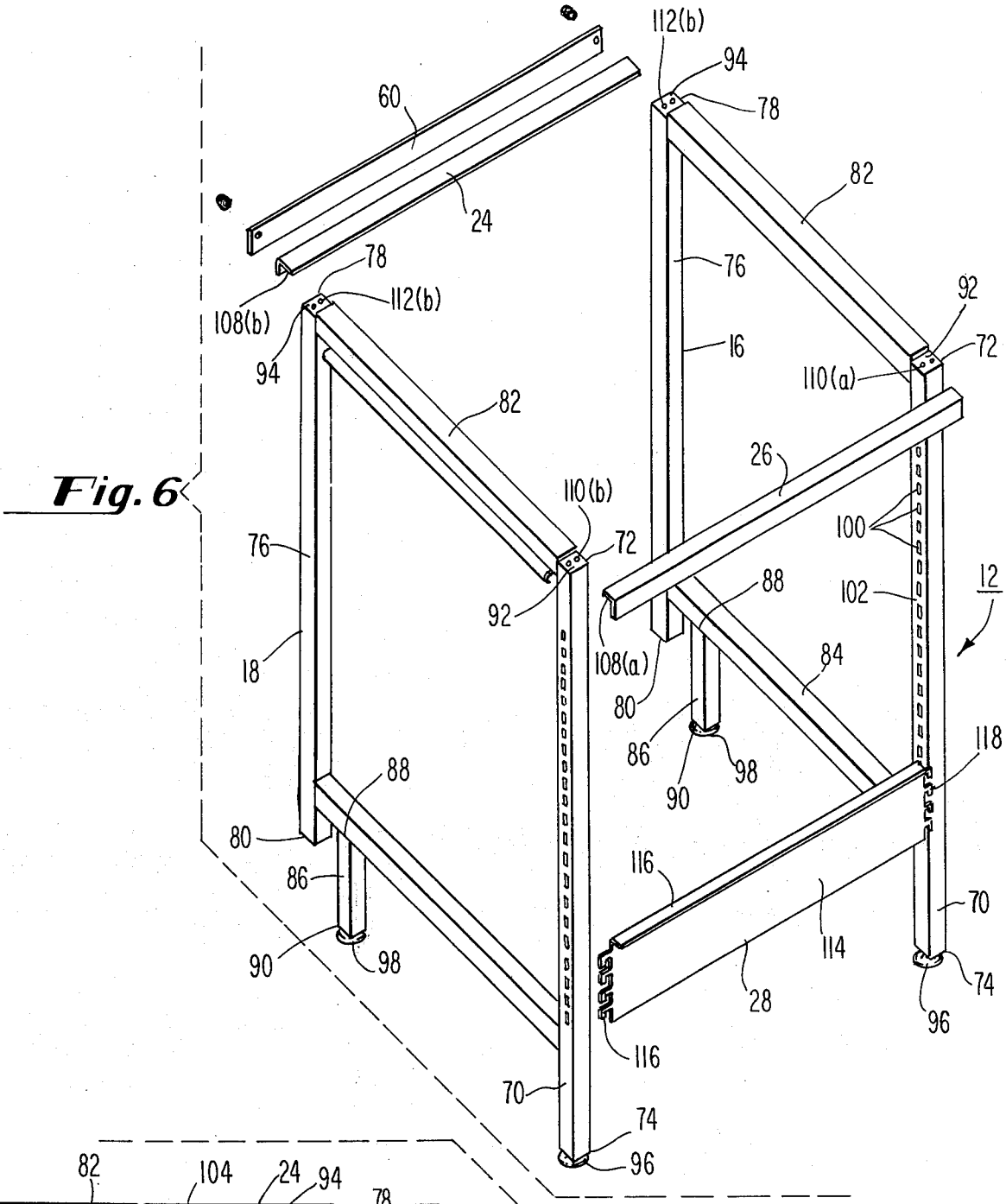
FIG. 6 is an isometric view of that portion of the floor mounted frame which defines a single modular spacing.

Frame assembly details will be described initially referring to FIG. 6 which shows, for reasons of clarity, only that portion of the frame 12 which defines the first single modular spacing therebetween (see FIG. 2). The remainder of the frame 12 is assembled in a similar fashion and it will be obvious from the description disclosed herein that the frame 12 can encompass a singular modular spacing, as shown in FIG. 6, two single and one double modular spacings as shown in FIGS. 1 and 2, or any combination and quantity of single and/or double modular spacings, the combinations being limited only by the dimensions of the intended use area. All of these combinations are intended to be within the scope and contemplation of the invention disclosed herein. As shown in FIG. 6, the frame 12 comprises a first 16 and a second 18 side support members. Each side support member comprises a rear leg 70, having an upper end 72 and a lower end 74, and a front vertical support bar 76 having an upper end 78 and a lower end 80. An upper horizontal support bar 82 is welded between the upper portions of the rear leg 70 and the front vertical support bar 76. A lower horizontal support bar 84 is welded between the lower portions of the rear leg 70 and the front vertical support bar 76.

A front leg 86, having an upper end 88 and a lower end 90, is welded to the lower horizontal support bar 84 and extends downwardly therefrom in substantially parallel spaced relation to the rear leg 70. The lower end 90 of the front leg 86 and the lower end 74 of the rear leg 70 are approximately equidistant from the upper horizontal support bar 82.

The rear leg 70, the front vertical support bar 76, the upper 82 and lower 84 horizontal support bars and the front leg 86 are hollow and substantially rectangular in cross-section. An end block 92 is mounted within the upper portion of the rear leg 70 such that the exposed face of the block 92 is substantially flush with the upper end 72 of the rear leg 70. In a similar manner, an end block 94 is mounted within the upper portion of the front vertical support bar 76 such that the exposed face of the block 94 is substantially flush with the upper end 78 of the front vertical support bar 76 (see FIG. 7). As shown in FIG. 6, levelling feet 96 and 98 are threadedly attached to the lower ends 74 and 90 of the rear and front legs 70 and 86 respectively. The rear leg 70 is provided with two sets of elongated slots for receiving bayonet-type hook elements. A first set of receiving apertures in the form of elongated slots 100 is vertically disposed in one side facing surface 102 of the rear leg 70 and a second set (not shown) is vertically disposed in the opposing sidefacing surface (not shown) with corresponding slots in the opposed surfaces being substantially equidistant from the lower end 74 of the rear leg 70.

The levelling feet 96 of 98 of each side support member rest on the floor. As described previously, the side support members 16 and 18 are connected to each other by means of a first angle bar 24, a second angle bar 26 and a first spacer bar 28. The first 24 and second 26 angle bars are identical, each having a substantially L-shaped cross-section with a horizontal portion 104 and a vertical portion 106 (see FIG. 7). A pair of pins 108(*a*) and 108(*b*) are rigidly attached to the horizontal portion 104 of each angle bar and extend downwardly therefrom. One pin 108(*a*) is positioned in proximity to one end of each angle bar and the other pin 108(*b*) is positioned in proximity to the other end.

Figure 7:
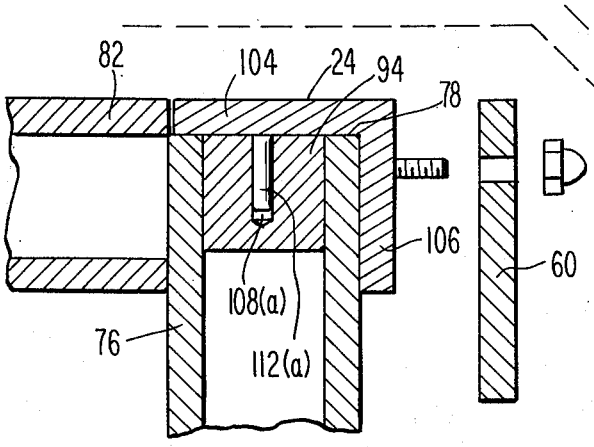
FIG. 7 is an enlarged sectional view of the upper end of a front vertical support bar of the frame.

The one pin 108(*a*) of the first angle bar 24 is inserted into a receiving aperture 112(*a*) in the end block 94 located in the front vertical support bar 76 of the first side support member 16 (see FIG. 7). Similarly, the other pin 108(*b*) of the first angle bar 24 is inserted into a receiving aperture 112(*b*) in the end block 94 of the second side support member 18. In addition, the one pin 108(*a*) of the second angle bar 26 is inserted into a receiving aperture 110(*b*) in the end block 92 located in the rear leg 70 of the second side support member 18. The other pin 108(*b*) of the second angle bar 26 is inserted into a receiving aperture 110(*a*) of the end block 92 of the first side support member 16. When the first and second angle bars 24 and 26 are in the connecting position, with the pins 108 inserted into their corresponding receiving apertures, the upper surface of the horizontal portion 104 of each angle bar is substantially co-planar with the upper surface of the horizontal support bar 82 of each connected side support member, as shown in FIG. 7, in order to provide a substantially planar support for the counter top 14 shown in FIGS. 1 and 5.

As shown in FIG. 1, the first spacer bar 28 comprises a plate 114 having a flange 116. Bayonet hooks 118 at the ends of the plate 114 are engageable in the elongated slots 100 in the facing surfaces of the rear leg 70 of each of the adjacent first and second side support members 16 and 18 respectively. The first 24 and second 26 angle bars and the first spacer bar 28, when connected to the adjacent first 16 and second 18 side support members determine a first single modular spacing therebetween as previously described. Using standard size angle bars and spacer bars, connected between adjacent side support members as described above, a frame, incorporating any desired combination of single and/or double modular spacings can be constructed.

For some uses, it may be desired to incorporate a sink module in the modular laboratory bench assembly of the present invention. This is accomplished as shown in FIGS. 2 and 8. To enable the incorporation of a sink, a pair of sink side support members are used. As shown in FIG. 8, and previously disclosed, the sink side support member is identical to the standard side support member (e.g. the first side support member 16 as shown in FIG. 6) except that the sink side support member has a channel member 120, as shown in FIG. 9, having opposed side walls 122 and 124 joined at one end by a base 126. The channel member 120 is rigidly attached to the upper horizontal support bar 82 by, for example, welding the base 126 of the channel member 120 to a lower surface 127 of the support bar 82. The other ends of the side walls 122 and 124 of the channel member 120 have retaining flanges 128 and 130 respectively which are directed inward towards one another forming an opening 132 therebetween which has a width sufficient to receive a threaded support rod 134 having a first end 136 and second end 138. Between the base 126 and the retaining flanges 128 and 130 of the channel member 120 is positioned a nut 140 with a threaded hole therein to receive one end of the threaded support rod 134.

To erect a sink module, a pair of sink side support members 18 and 20 are connected by a pair of angle bars 30 and 32 and a spacer bar 34 as previously described. The angle bars and spacer bar can be sized to define a single or double modular spacing between the sink side support members in order to support a single or double sink as desired. FIGS. 2 and 8 show a single modular spacing between the sink side support members 18 and 20. Two nuts are positioned between the base and the retaining flanges (not shown) of the channel member 120(*a*) of the sink side support member 18. Similarly, two nuts are positioned between the base and the retaining flanges (not shown) of the channel member 120(*b*) of the sink side support member 20. The first ends 136 of the first (not shown) and a second 134(*b*) threaded rods are screwed into the nuts in the channel member 120(*a*). Likewise, the first ends 136 of a third 134(*c*) and fourth 134(*d*) threaded rods are screwed into the two nuts in the channel member 120(*b*). The second end 138 of the first threaded rod is inserted through a receiving aperture 142 which extends completely through a first bar support 144 adjacent a first end 146 thereof (see FIG. 9). A nut 148(*a*) is screwed onto the second end 138 of the threaded rod 134. Similarly, the second end 138(*c*) of the third threaded rod 134(*c*) is inserted through a receiving aperture 142(*c*) extending completely through the first bar support 144 adjacent a second end 150 thereof. A nut 148(*c*) is screwed onto the second end 138(*c*) of the third threaded rod 134(*c*). The nuts 148(*a*) and 148(*c*) support the first bar support 144 at a desired distance below the upper horizontal support bars 82 of the sink side support members 18 and 20. A second bar support 152 is similarly supported at a desired distance below the upper horizontal support bars 82 by a nut 148(*b*) screwed onto the second end 138(*b*) of the second threaded rod 134(*b*) and a nut 148(*d*) screwed onto the second end 138(*d*) of the fourth threaded rod 134(*d*).

A sink 154 having a top edge 156 is inserted into the space defined by the upper horizontal support bars 82 of the sink side support members 18 and 20 and the angle bars 30 and 32 connected therebetween. The sink rests upon the first 144 and second 152 bar supports. The distance below the horizontal support bars 82 of the bar supports 144 and 152 is adjusted using the nuts 148 until the plane defined by the top edge 156 of the sink 154 is substantially coincident with the plan defined by the upper surfaces of the angle bars 30 and 32 and the upper horizontal support bars 82. The counter top 14 has an aperture 158 therein (see FIG. 1) which is slightly smaller than the inside dimensions of the sink 154. When the counter top 14 is mounted on the frame 12, the sink 154 is centered beneath the aperture 158 in the counter top. The aperture 158 is dimensioned such that it preferably forms a 1/16 inch lip over the inside dimension of the sink 154. It is preferred that caulking be applied to the intersection of the inner surface of the sink 154 and the lip.

The modular laboratory bench assembly of the present invention is installed at the using site as follows. It should be noted that, as previously stated, the modular construction of the bench assembly disclosed herein affords the user a selection of configurations comprising any desired quantity and combination of single and/or double modular spacings, with or without a sink. For purposes of description, it is assumed that the user has ordered a bench assembly configuration as shown in FIG. 1.

The first step is assembling the frame 12 in the intended use location using the standardized frame components required for the particular configuration selected. For the configuration shown in FIG. 1, the standardized components required include two side support members, two sink side support members, which are indentical to the side support member with the addition of a channel member, four angle bars and two spacer bars of a length defining a single modular spacing, two angle bars and a spacer bar of a length defining a double modular spacing, two support bars, four threaded rods and eight nuts. The frame is assembled and levelled as previously described and shown in FIG. 2.

As shown in FIG. 5, the counter top 14 is mounted on the assembled frame 12 and is attached thereto using any suitable fastening means such as an epoxy cement. As previously described, the sink 154 is centered with respect to the aperture 158 in the installed counter top 14. As shown in FIG. 5, the counter top 14 has a backsplash 160. A duplex electrical outlet 162 is installed on the upper surface 15 of the counter top 14. In addition, three double gas valves 164(*a*), and (*b*), and (*c*) are also installed on the upper surface 15 of the counter top 14, adjacent the backsplash 160. Also, a faucet 166 is installed on the upper surface 15 between the backsplash 160 and the sink 154. the backsplash and the quantity and location of the laboratory utility service outlets are shown as examples only. The actual configuration of the counter top 14 as well as the quantity and location of electrical outlets, gas outlets, faucets, etc. would be specified by the user and the counter top 14 would be custom made to accommodate the user's requirements.

After mounting the counter top 14 on the frame 12, the fluid, gas and electrical service connections, generally designated as 168 in FIG. 5, are made from the service piping brought up to 6–8 inches above the floor in a directed location, commonly referred to as "stub ups," to the outlets mounted on the counter top 14. The assembled frame 12, without the cabinet units installed, permits relatively open access to allow tradesmen to make the required service connections. After the service connections have been made, the desired modular cabinet units can be wheeled into the appropriate modular spacings within the assembled frame 12 as shown in FIG. 5. Or, if so desired by the customer, the cabinet units can be installed at a later date after all construction work has been completed.

FIG. 10 shows the third modular cabinet unit 46 installed within the frame 12. The frame 12 has sufficient depth to receive a modular cabinet unit having a depth of twenty-four inches. As shown in FIG. 10, the third modular cabinet unit 46 has a depth of less than 24 inches; therefore, a cabinet spacer 170, supported by the spacer bar (not shown), is required to maintain a front surface 172 of the installed modular cabinet unit 46 in substantially co-planar relationship with the front surface 174 of the angle bar 36. To accomplish this, the cabinet spacer 170 maintains a predetermined spacing between a rear surface 173 of the modular cabinet unit 46 and the spacer bar (not shown).

Figure 11:
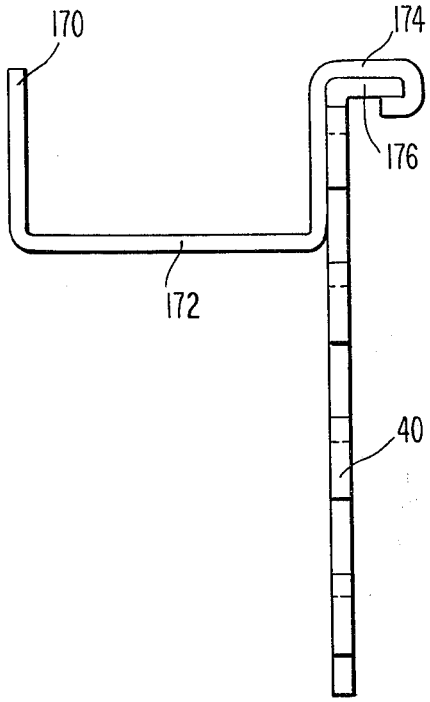
FIG. 11 is an end elevational view of a spacer bar having a cabinet spacer mounted thereon.

As shown in FIG. 11, the cabinet spacer 170 comprises a U-shaped member 172 having a J-shaped retaining flange 174 at one end thereof. The J-shaped retaining flange 174 is dimensioned such that it slides over the flange 176 of the third spacer bar 40 for the example shown in FIG. 10. The spacer bar 170 has a longitudinal dimension which is less than the dimension between the two sets of bayonet hooks at each end of the supporting spacer bar.

If the cabinet unit to be used has a depth of 24 inches, the cabinet spacer will not be required and the substantially coplanar relationship of the front surface 172 of this installed modular cabinet unit and the front surface 174 of the angle bar 36 will be maintained by allowing the rear surface 173 of the cabinet unit to contact the spacer bar (not shown). Note that the installation of the third modular cabinet unit 46 within the frame 12 as depicted in FIG. 10 is exemplary of the installation of any cabinet unit in the bench assembly of the present invention. The only difference being that some cabinet units, that is those having a depth less than 24 inches, will require a cabinet spacer to maintain the substantially coplanar relationship of the front surfaces of the cabinet unit and the angle bar.

As previously stated, the cabinet units are retained within the frame 12 by means of a faceplate attached to the front angle bar by any suitable attachment means. A preferred means of attachment is shown in FIG. 10. Using this means of attachment, the third modular cabinet unit 46 is held within the frame 12 by the faceplate 64 which is attached to the front angle bar 36 by means of a pair of threaded studs 178 which are attached to and protude from the front surface 174 of the front angle bar 36. The faceplate is installed such that each threaded stud 178 extends through an aperture 180 in the faceplate 64. The faceplate is held in place against the coplanar front surfaces of the front angle bar 36 and the cabinet unit 46 by suitable means such as a cap screw 182 screwed onto each threaded stud 178.

As shown in FIG. 10, the height of the frame 12 is adjusted, using the levelling feet 96 and 98, such that the lower edge of the front surface 174 of the front angle bar 36 is just high enough above the floor to permit the modular cabinet units to be wheeled thereunder. The spacing between the lower edge of the front surface of the front angle bar and the top of the installed cabinet unit is typically on the order of ¼ inch. As shown in FIG. 10, a lower edge 184 of the installed faceplate 64 overhangs the top of the installed cabinet unit 46. The overhang is typically on the order of ¾ inch and it is the overhanging portion of the installed faceplate which retains the installed cabinet unit within the frame.

Figure 13:
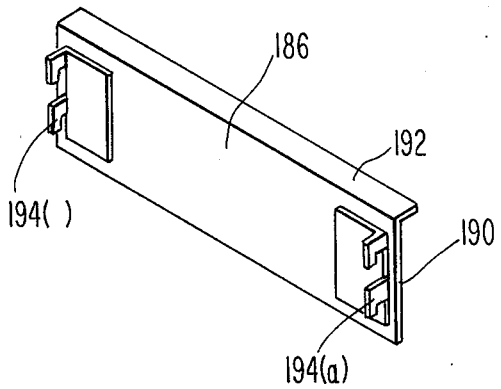
FIG. 13 is an isometric view of an island spacer bar.
Figure 12:
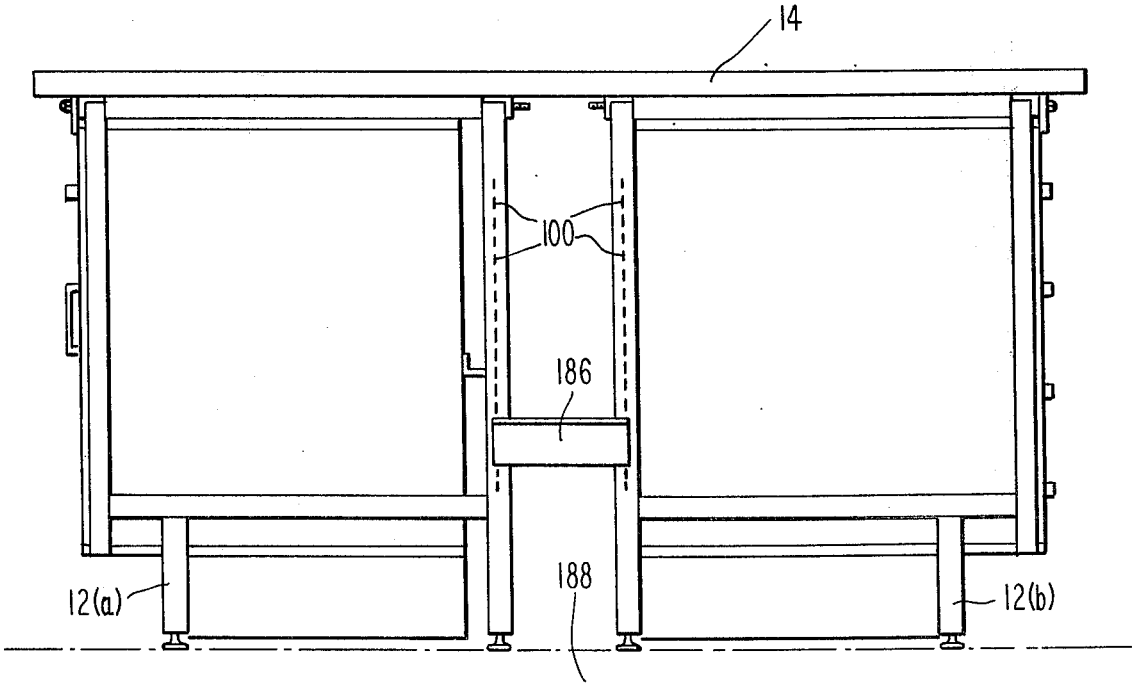
FIG. 12 is an end elevational view of the modular laboratory bench assembly of the present invention in a back-to-back island configuration.

FIG. 12 illustrates the versatility of the modular laboratory bench assembly of the present invention. FIG. 12 shows a back-to-back island configuration designed for installation on the floor away from the walls of the use area. The island configuration comprises two frame structures 12(*a*) and 12(*b*), the rear portions of which are held together by an island spacer bar 186 which defines a predetermined spacing 188 between the frame structures. A single counter top 14 may be mounted on both frame structures thereby providing a single, large area work surface. The spacing 188 between the frame structures 12(*a*) and 12(*b*) can be used to contain the fluid, gas and electric service connections required. As shown in FIG. 13, the island spacer bar 186 comprises a plate 190 having a flange 192 extending from the plate 190 in a first direction. Two sets of bayonet hooks 194(*a*) and 194(*b*), extending in a direction opposite to the first direction of the flange 192, are mounted on the plate 190 adjacent each end thereof. The bayonet hooks are engageable in the slots 100 in the rear leg 70 of the side support members located at the ends of each of the frames 12(*a*) and 12(*b*) (see FIG. 12).

One of the primary advantages of the modular laboratory bench assembly of the present invention lies in the wide assortment of possible installation configurations using only a small number of standardized components. As previously described, the construction of the basic frame requires two identical side support members, two identical angle bars and one spacer bar. The modular spacing between the side support members is defined by the length of the angle bars and the spacer bar. This modular spacing can be any width up to 60 inches, depending upon the needs of the customer, by merely providing angle bars and spacer bars of the desired length. Note, for purposes of maintaining manageable inventories of standardized parts, it is preferred that the standard modular widths be limited to 18, 24, 36 and 48 inches with other desired widths being custom made when requested.

In addition, the modular spacing can receive, as previously stated, cabinet modules having any depth up to twenty-four inches by merely using the appropriate cabinet spacer. Again, for purposes of standardization, it is preferred that the standard depths be twenty, twenty-two and twenty-four inches. As stated in the detailed description, additional standard or sink side support members can be connected using angle bars and spacer bars to expand the basic frame to accommodate a counter top of practically any length. In addition, an island structure can be constructed using back-to-back frames connected by island spacer bars.

Although not previously described in detail, the modular laboratory bench assembly can be constructed to fit against two or more adjoining walls in an L-shaped or U-shaped configuration. This is accomplished by constructing a frame in the desired configuration adjacent each wall, and positioning the front vertical support bars of the side support members at the adjacent ends of the two frames in abutting relationship. The rectangular space defined by the adjoining walls and the upper horizontal support bars of the side support members at the adjacent ends of the two frames is convered by designing the counter top of either frame to extend beyond the side support member at the end of the frame to the wall where it could be supported by, for example, a supporting block mounted to the wall.

Another of the advantages of the modular laboratory bench assembly of the present invention is that the frame supports only the sink and the counter top. The modular cabinet units, although conveniently housed within the frame, are supported by the floor. This feature enables the use of a relatively light, open frame comprising only a few standardized types of interconnected members such as side support members, angle bars, and spacer bars.

Still another advantage lies in the simplicity of the on site construction. The frame members, counter top and sink (if desired) are shipped disassembled to the use location. The frame is then assembled and the sink and counter top installed at the site by average workers using a minimum of standard tools such as a ball pean hammer for assembling the frame and an adjustable wrench for adjusting sink supports. Once the frame, counter top and sink have been assembled, the tradespeople can connect the required fluid, gas and electric service from the "stub ups" to the outlets in the cabinet system. These connections are accomplished with a minimum of obstruction due to the open construction of the assembled frame.

Once the service connections have been made, the modular cabinet units can be simply wheeled into their receiving spaces within the assembled frame. Each modular cabinet unit is then secured within the frame by a faceplate and two cap screws. Note that the user may desire, for financial or other reasons, to purchase the modular cabinet units at a later time. In this event, the modular laboratory bench assembly of the present invention is still usable for all intended functions (e.g. a laboratory work surface with utility services) except storage. The modular cabinet units can be installed at any later time without disrupting the other functions of the laboratory bench assembly by merely wheeling the cabinet units into place and attaching their respective faceplates.

I claim:

1. A modular laboratory bench assembly including a counter top and a floor mounted frame for supporting said counter top at a predetermined height above the floor, said frame comprising:

a. at least two rigid, preassembled side support members, each of which comprises:

i. a rear leg having an upper end with a pair of receiving apertures therein, a lower end and opposing side surfaces positioned to face adjacent side support members when assembled into a frame, said side surfaces having a plurality of apertures therein;

ii. a front vertical support bar having an upper end, with a pair of receiving apertures therein, and a lower end, said front vertical support bar being shorter than said rear leg;

iii. an upper horizontal support bar rigidly connected between the upper ends of the front vertical support bar and the rear leg;

iv. a lower horizontal support bar rigidly connected between the lower end of the front vertical support bar and the rear leg; and v. a front leg rigidly attached to the lower horizontal support bar and extending downwardly therefrom in substantially parallel spaced relation to the rear leg;

b. means for engaging the receiving apertures and rigidly interlocking adjacent side support members at a distance which defines a predetermined modular spacing therebetween, said means comprising:

i. a front angle bar having a substantially L-shaped cross-section with intersecting inner surfaces and a first pin depending from one of said inner surfaces adjacent one end of said bar for engaging a receiving aperture in the upper end of the front vertical support bar of a first side support member and a second pin depending from said one inner surface adjacent the other end of said bar for engaging a receiving aperture in the upper end of the front vertical support bar of a second side support member adjacent said first side support member, the distance between said first and second pins being fixed such that said predetermined modular spacing is maintained between said adjacent side support members;

ii. a rear angle bar having a substantially L-shaped cross-section with intersecting inner surfaces and a first pin depending from one of said inner surfaces adjacent one end of said bar for engaging a receiving aperture in the upper end of the rear leg of the first side support member and a second pin depending from said one inner surface adjacent the other end of said bar for engaging a receiving aperture in the upper end of the rear leg of the adjacent side support member, the distance between the first and second pins being fixed such that said predetermined modular spacing is maintained between said adjacent side support members; and iii. a rear spacer bar having hooks extending from each end thereof, said hooks being adapted for locking engagement in the facing side surfaces of adjacent side support members; and c. means for levelling said frame.

2. A modular laboratory bench assembly in accordance with claim 1 wherein the rear leg, the front vertical support bar, the upper horizontal support bar, the lower horizontal support bar and the front leg of each side support member are hollow, having a substantially rectangular cross-section.

3. A modular laboratory bench assembly in accordance with claim 2 wherein said levelling means comprise vertically adjustable levelling feet threadedly attached to the lower ends of the front and rear legs of each side support member.

4. A modular laboratory bench assembly in accordance with claim 3 wherein the receiving apertures in the side surfaces of said rear leg of each side support member are elongated slots, and the hooks extending from each end of the rear spacer bar are bayonet hooks adapted for locking engagement in said elongated slots.

5. A modular laboratory bench assembly including a counter top having an aperture therein, a sink and a floor mounted frame for supporting said counter top at a predetermined height above said floor, said frame comprising:

a. a plurality of rigid, preassembled side support members, at least one adjacent pair of which are sink side support members, wherein each side support member comprises:

i. a rear leg having an upper end with a pair of receiving apertures therein, a lower end and opposing side surfaces positioned to face adjacent side support members when assembled into a frame, said side surfaces having a plurality of receiving apertures therein;

ii. a front vertical support bar having an upper end, with a pair of receiving apertures therein, and a lower end, said front vertical support bar being shorter than said rear leg;

iii. an upper horizontal support bar rigidly connected between the upper ends of the front vertical support bar and the rear leg;

iv. a lower horizontal bar rigidly connected between the lower end of the front vertical support bar and the rear leg; and v. a front leg rigidly attached to the lower horizontal support bar and extending downwardly therefrom in substantially parallel spaced relation to the rear leg;

b. means for engaging the receiving apertures and interlocking adjacent side support members at a predetermined modular spacing therebetween;

c. means for supporting said sink beneath the aperture in said counter top within the modular spacing defined between the adjacent pair of sink side support members; and d. means for levelling said frame.

6. A modular laboratory bench assembly in accordance with claim 5 wherein said sink side support member comprises a side support member with a U-shaped channel member, having inwardly directed retaining flanges on the sidewalls thereof, extending between the front vertical support bar and the rear leg, said channel member being rigidly attached to a lower surface of the upper horizontal support bar.

7. A modular laboratory bench assembly in accordance with the claim 6 wherein said sink supporting means comprises at least two vertically adjustable support bars which extend across the modular spacing defined between the adjacent pair of sink side support members, one end of each support bar being threadedly attached to the U-shaped channel member of one sink side support member and the other end being threadedly attached to the U-shaped channel member of the adjacent sink side support member.

8. A modular laboratory bench assembly in accordance with claim 7 wherein said engaging and interlocking means comprises:

a. a front angle bar having a substantially L-shaped cross-section with intersecting inner surfaces and a first pin depending from one of said inner surfaces adjacent one end of said bar for engaging a receiving aperture in the upper end of the front vertical support bar of a first side support member and a second pin depending from said one inner surface adjacent the other end of said bar for engaging a receiving aperture in the upper end of the front vertical support bar of a second side support member adjacent said first side support member, the distance between said first and second pins being fixed such that said predetermined modular spacing is maintained between said adjacent side support members;

b. a rear angle bar having a substantially L-shaped cross-section with intersecting inner surfaces and a first pin depending from one of said inner surfaces adjacent one end of said bar for engaging a receiving aperture in the upper end of the rear leg of the first side support member and a second pin depending from said one inner surface adjacent the other end of said bar for engaging a receiving aperture in the upper end of the rear leg of the adjacent second side support member, the distance between the first and second pins being fixed such that said predetermined modular spacing is maintained between said adjacent side support members; and c. a rear spacer bar having hooks extending from each end thereof, said hooks being adapted for locking engagement in the receiving apertures in the facing side surfaces of adjacent side support members.

9. A modular laboratory bench assembly in accordance with claim 8 wherein the rear leg, the front vertical support bar, the upper horizontal support bar, the lower horizontal support bar and the front leg of each side support member are hollow, having a substantially rectangular cross-section.

10. A modular laboratory bench assembly in accordance with claim 9 wherein said levelling means comprise vertically adjustable levelling feet threadedly attached to the lower ends of the front and rear legs of each side support member.

11. A modular laboratory bench assembly in accordance with claim 10 wherein the receiving apertures in the side surfaces of said rear leg of each side support member are elongated slots, and the hooks extending from each end of the rear spacer bar are bayonet hooks adapted for locking engagement in said elongated slots.

12. A modular laboratory bench assembly comprising:

a. a counter top;

b. a floor mounted frame for supporting said counter top at a predetermined height above the floor, said frame comprising at least two rigid, preassembled side support members having a plurality of receiving apertures therein and means for engaging the receiving apertures and rigidly interlocking adjacent side support members at a distance which defines a predetermined modular spacing therebetween;

c. at least one floor supported modular cabinet unit, dimensioned to enable installation of said cabinet unit beneath said counter top within said modular spacing, said cabinet unit having sides, a back, a front and a base with means for supporting the weight of the installed cabinet unit independent of said frame and for enabling movement of said cabinet unit across the floor; and d. means, removeably attached to said frame, for securing the installed cabinet unit within said modular spacing.

13. A modular laboratory bench assembly in accordance with claim 12 including means for levelling said frame.

14. A modular laboratory bench assembly in accordance with claim 13 wherein each side support member comprises:

a. a rear leg having an upper end with a pair of receiving apertures therein, a lower end and opposing side surfaces positioned to face adjacent side support members when assembled into a frame, said side surfaces having a plurality of receiving apertures therein;

b. a front vertical support bar having an upper end, with a pair of receiving apertures therein, and a lower end, said front vertical support bar being shorter than said rear leg;

c. an upper horizontal support bar rigidly connected between the upper ends of the front vertical support bar and the rear leg;

d. a lower horizontal support bar rigidly connected between the lower end of the front vertical support bar and the rear leg; and e. a front leg ridigly attached to the lower horizontal support bar and extending downwardly therefrom in substantially parallel spaced relation to the rear leg.

15. A modular laboratory bench assembly in accordance with claim 14 wherein said engaging and interlocking means comprises:

a. a front angle bar having a substantially L-shaped cross-section with intersecting inner surfaces and a first pin depending from one of said inner surfaces adjacent one end of said bar for engaging a receiving aperture in the upper end of the front vertical support bar of a first side support member and a second pin depending from said one inner surface adjacent the other end of said bar for engaging a receiving aperture in the upper end of the front vertical support bar of a second side support member adjacent said first side support member, the distance between said first and second pins being fixed such that said predetermined modular spacing is maintained between said adjacent side support members;

b. a rear angle bar having a substantially L-shaped cross-section with intersecting inner surfaces and a first pin depending from one of said inner surfaces adjacent one end of said bar for engaging a receiving aperture in the upper end of the rear leg of the first side support member and a second pin depending from said one inner surface adjacent the other end of said bar for engaging a receiving aperture in the upper end of the rear leg of the adjacent second side support member, the distance between the first and second pins being fixed such that said predetermined modular spacing is maintained between said adjacent side support members; and c. a rear spacer bar having hooks extending from each end thereof, said hooks being adapted for locking engagement in the receiving apertures in the facing side surfaces of adjacent side support members.

16. A modular laboratory bench assembly in accordance with claim 15 wherein the rear leg, the front vertical support bar, the upper horizontal support bar, the lower horizontal support bar and the front leg of each side support member are hollow, having a substantially rectangular cross-section.

17. A modular laboratory bench assembly in accordance with claim 16 wherein said levelling means comprise vertically adjustable levelling feet threadedly attached to the lower ends of the front and rear legs of each side support member and adapted to permit height adjustment of said front and rear angle bars.

18. A modular laboratory bench assembly in accordance with claim 17 wherein the receiving apertures in the side surfaces of said rear leg of each side support member are elongated slots, and the hooks extending from each end of the rear spacer bar are bayonet hooks adapted for locking engagement in said elongated slots.

19. A modular laboratory bench assembly in accordance with claim 18 wherein said means for supporting the weight and enabling the movement of said cabinet unit comprise at least three casters attached to the base of said cabinet unit.

20. A modular laboratory bench assembly in accordance with claim 19 wherein said installed cabinet unit securing means comprises a substantially rectangular faceplate extending across said modular spacing, said faceplate being removeably attached to said front angle bar and having a lower portion which overhangs an upper portion of the front of said installed cabinet unit.

21. A modular laboratory bench assembly comprising:

a. a counter top having an aperture therein;

b. a sink;

c. a floor mounted frame for supporting said counter top at a predetermined height above the floor, said frame comprising:

i. a plurality of rigid, preassembled side support members, at least one adjacent pair of which are sink side support members, each side support member having a plurality of receiving apertures therein;

ii. means for engaging the receiving apertures and interlocking adjacent side support members at a predetermined modular spacing therebetween, and iii. means for supporting said sink beneath the aperture in said counter top within the modular spacing defined between the adjacent pair of sink side support members;

d. at least one floor supported modular cabinet unit, dimensioned to enable installation of said cabinet unit beneath said counter top within said modular spacing, said cabinet unit having sides, a back, a front and a base with means for supporting the weight of the installed cabinet unit independent of said frame and for enabling movement of said cabinet unit across the floor; and e. means, removeably attached to said frame, for securing the installed cabinet unit within said modular spacing.

22. A modular laboratory bench assembly in accordance with claim 21 including means for levelling said frame.

23. A modular laboratory bench assembly in accordance with claim 22 wherein each side support member comprises:

a. a rear leg having an upper end with a pair of receiving apertures therein, a lower end and opposing side surfaces positioned to face adjacent side support members when assembled into a frame, said side surfaces having a plurality of receiving apertures therein;

b. a front vertical support bar having an upper end, with a pair of receiving apertures therein, and a lower end, said front vertical support bar being shorter than said rear leg;

c. an upper horizontal support bar rigidly connected between the upper ends of the front vertical support bar and the rear leg;

d. a lower horizontal support bar rigidly connected between the lower end of the front vertical support bar and the rear leg; and e. a front leg rigidly attached to the lower horizontal support bar and extending downwardly therefrom in substantially parallel spaced relation to the rear leg.

24. A modular laboratory bench assembly in accordance with claim 23 wherein said sink side support member comprises a side support member with a U-shaped channel member, having inwardly directed retaining flanges on the sidewalls thereof, extending between the front vertical support bar and the rear leg, said channel member being rigidly attached to a lower surface of the upper horizontal support bar.

25. A modular laboratory bench assembly in accordance with claim 24 wherein said sink supporting means comprises at least two vertically adjustable support bars which extend across the modular spacing defined between the adjacent pair of sink side support members, one end of each support bar being threadedly attached to the U-shaped channel member of one sink side support member and the other end being threadedly attached to the U-shaped channel member of the adjacent sink side support member.

26. A modular laboratory bench assembly in accordance with claim 25 wherein said engaging and interlocking means comprises:

a. a front angle bar having a substantially L-shaped cross-section with intersecting inner surfaces and a first pin depending from one of said inner surfaces adjacent one end of said bar for engaging a receiving aperture in the upper end of the front vertical support bar of a first side support member and a second pin depending from said one inner surface adjacent the other end of said bar for engaging a receiving aperture in the upper end of the front vertical support bar of a second side support member adjacent said first side support member, the distance between said first and second pins being fixed such that said predetermined modular spacing is maintained between said adjacent side support members;

b. a rear angle bar having a substantially L-shaped cross-section with intersecting inner surfaces and a first pin depending from one of said inner surfaces adjacent one end of said bar for engaging a receiving aperture in the upper end of the rear leg of the first side support member and a second pin depending from said one inner surface adjacent the other end of said bar for engaging a receiving aperture in the upper end of the rear leg of the adjacent second side support member, the distance between the first and second pins being fixed such that said predetermined modular spacing is maintained between said adjacent side support members; and c. a rear spacer bar having hooks extending from each end thereof, said hooks being adapted for locking engagement in the receiving apertures in the facing side surfaces of adjacent side support members.

27. A modular laboratory bench assembly in accordance with claim 26 wherein the rear leg, the front vertical support bar, the upper horizontal support bar, the lower horizontal support bar and the front leg of each side support member are hollow, having a substantially rectangular cross-section.

28. A modular laboratory bench assembly in accordance with claim 27 wherein said levelling means comprise vertically adjustable levelling feet threadedly attached to the lower ends of the front and rear legs of each side support member, and adapted to permit height adjustment of said front and rear angle bars.

29. A modular laboratory bench assembly in accordance with claim 28 wherein the receiving apertures in the side surfaces of said rear leg of each side support members are elongated slots, and the hooks extending from each end of the rear spacer bar are bayonet hooks adapted for locking engagement in said elongated slots.

30. A modular laboratory bench assembly in accordance with claim 29 wherein said means for supporting the weight and enabling the movement of said cabinet unit comprise at least three casters attached to the base of said cabinet unit.

31. A modular laboratory bench assembly in accordance with claim 30 wherein said installed cabinet unit securing means comprises a substantially rectangular faceplate extending across said modular spacing, said faceplate being removeably attached to said front angle bar and having a lower portion which overhangs an upper portion of the front of said installed cabinet unit.

* * * * *